US009518548B2

(12) United States Patent
Kawata

(10) Patent No.: US 9,518,548 B2
(45) Date of Patent: Dec. 13, 2016

(54) FUEL SUPPLY APPARATUS OF INTERNAL COMBUSTION ENGINE

(71) Applicant: SUZUKI MOTOR CORPORATION, Hamamatsu-shi, Shizuoka (JP)

(72) Inventor: Koichiro Kawata, Hamamatsu (JP)

(73) Assignee: SUZUKI MOTOR CORPORATION, Hamamatsu-Shi, Shizuoka (JP)

( * ) Notice: Subject to any disclaimer, the term of this patent is extended or adjusted under 35 U.S.C. 154(b) by 167 days.

(21) Appl. No.: 14/322,153

(22) Filed: Jul. 2, 2014

(65) Prior Publication Data

US 2015/0007794 A1 Jan. 8, 2015

(30) Foreign Application Priority Data

Jul. 3, 2013 (JP) ..... 2013-139883

(51) Int. Cl.
*F02M 69/04* (2006.01)

(52) U.S. Cl.
CPC ..... *F02M 69/04* (2013.01); *F02M 69/042* (2013.01); *F02M 69/046* (2013.01)

(58) Field of Classification Search
CPC F02M 69/465; F02M 35/10216; F02M 39/00; F02M 35/10177
USPC ..... 123/445, 468, 579; 180/219
See application file for complete search history.

(56) References Cited

U.S. PATENT DOCUMENTS

2011/0315099 A1* 12/2011 Uchiyama ..... B62J 37/00 123/54.4
2013/0186370 A1* 7/2013 Uchiyama ..... F02M 63/0275 123/445
2014/0182556 A1* 7/2014 Nishimura ..... F02M 35/10242 123/470
2014/0318499 A1* 10/2014 Tanaka ..... F02D 41/30 123/478

FOREIGN PATENT DOCUMENTS

EP 2402589 A2 1/2012
JP H10-077908 3/1998

OTHER PUBLICATIONS

German Office Action dated Jun. 2, 2015, which issued during prosecution of German Application No. 10 2014 109 035.7.

* cited by examiner

*Primary Examiner* — Marguerite McMahon
*Assistant Examiner* — James Kim
(74) *Attorney, Agent, or Firm* — Troutman Sanders LLP

(57) ABSTRACT

A secondary injector that is one of a plurality of injectors provided for each cylinder is arranged in an air cleaner and above an air funnel, and the secondary injector and the air funnel facing the secondary injector are arranged to be inclined such that a base portion of the secondary injector on an outer side in a vehicle width direction is biased to a center side in the vehicle width direction and an injection port thereof is directed to a throttle body.

9 Claims, 15 Drawing Sheets

FUEL SUPPLY APPARATUS OF INTERNAL COMBUSTION ENGINE

CROSS-REFERENCE TO RELATED APPLICATIONS

This application is based upon and claims the benefit of priority of the prior Japanese Patent Application No. 2013-139883, filed on Jul. 3, 2013, the entire contents of which are incorporated herein by reference.

BACKGROUND OF THE INVENTION

1. Field of the Invention

The present invention typically relates to a fuel supply apparatus of an internal combustion engine in a motorcycle and the like in which a parallel multicylinder engine is mounted.

2. Description of the Related Art

In an engine with a large lateral width such as a parallel four-cylinder engine or the like in a motorcycle, a throttle body, a secondary injector and an air cleaner and so on surrounding them, which are arranged at an upper part of the engine, also become large in lateral width to increase the lateral width of a vehicle frame. However, a portion of the vehicle frame large in lateral width is a portion corresponding to the elbows and the knees of a rider and therefore decreases the degree of freedom at riding of the rider and deteriorates the aerodynamic performance due to the large lateral width.

For example, Patent Document 1 discloses an intake apparatus in which the width of a vaporizer unit is decreased to decrease the vehicle frame width. In this intake apparatus, the path from an intake valve of the engine to a throttle body is tilted so as to make the pitch width between throttle bodies smaller than the pitch between cylinders, thereby decreasing the vehicle frame width (Patent Document 1, FIG. 17 and so on).

[Patent Document 1] Japanese Laid-open Patent Publication No. 10-077908

However, in the conventional apparatus as described above, a certain distance is required to gradually tilt the path from the intake valve of the engine to the throttle body. Therefore, the distance from the intake valve to the throttle body becomes longer to cause a decrease in response (accelerator response) of the engine. Further, the intake path is tilted at a position where the flow velocity is increased after the throttle body (on the intake downstream side) and thereby causes a problem such as a decrease in engine output and so on.

SUMMARY OF THE INVENTION

Under consideration of the above circumstances, an object of the present invention is to provide a fuel supply apparatus of an internal combustion engine capable of effectively improving the degree of freedom at riding, the aerodynamic performance and so on.

A fuel supply apparatus of an internal combustion engine of the present invention in which a throttle body is arranged in a vertical posture in an intake passage that links an air cleaner arranged above a parallel multicylinder engine to an engine combustion chamber, the fuel supply apparatus includes: an injector that injects fuel and an air funnel which are provided in the intake passage; and a secondary injector that is one of a plurality of the injectors provided for each cylinder and arranged in the air cleaner and above the air funnel, wherein the secondary injector and the air funnel facing the secondary injector are arranged to be inclined such that a base portion of the secondary injector on an outer side in a vehicle width direction is biased to a center side in the vehicle width direction and an injection port thereof is directed to the throttle body.

Further, in the fuel supply apparatus of an internal combustion engine of the present invention, an air cleaner body has side surfaces formed to be narrow on an upper surface side in a manner to follow the inclination of the secondary injector and the air funnel, and has an upper surface having an opening portion that is closed by an air cleaner upper lid mounted thereon via a seal member, and wherein vehicle frame extending from a steering head pipe to a rear of a vehicle are arranged on both the side surfaces of the air cleaner body and form substantially uniform gaps along the side surfaces of the air cleaner body.

Further, the fuel supply apparatus of an internal combustion engine of the present invention, further includes: a secondary delivery pipe and a pipe support post, the secondary injector being supported by and fixed to the pipe support post fastened to an air cleaner bottom plate via the secondary delivery pipe.

Further, the fuel supply apparatus of an internal combustion engine of the present invention, further includes: a fuel tank and a fuel pump, the fuel tank with the fuel pump mounted on a lower surface thereof being adjacently arranged on a vehicle rear side of the air cleaner; a first fuel supply pipe that connects with the fuel pump, a primary injector that is another of the injectors, and a primary delivery pipe that supplies fuel to the primary injector, the first fuel supply pipe being connected to one end side of the primary delivery pipe; a second fuel supply pipe that connects with another end side of the primary delivery pipe and is connected to one end side of the secondary delivery pipe; and a fuel feedback pipe that connects with another end side of the secondary delivery pipe and is connected to the fuel pump.

Further, the fuel supply apparatus of an internal combustion engine of the present invention, further includes: a joint, the second fuel supply pipe being inserted into an inside of the air cleaner from an outside via the joint and arranged inside the air cleaner.

Further, the fuel supply apparatus of an internal combustion engine of the present invention, further includes: a joint of the secondary delivery pipe that is arranged in a manner to project from a communication hole in an upper surface of the air cleaner, corresponding to another end side of the secondary delivery pipe, and the fuel feedback pipe being inserted from above and connected to the joint.

Further, the fuel supply apparatus of an internal combustion engine of the present invention, further includes: a joint, the first fuel supply pipe being divided into two halves via the joint at an appropriate middle point in a manner to be separated from and connected to each other.

Further, in the fuel supply apparatus of an internal combustion engine of the present invention, the first fuel supply pipe extended from a discharge port of the fuel pump to a left side in a rear view of the air cleaner passes on an inner side in the vehicle width direction of the fuel feedback pipe and is arranged upward, passes on an upper surface at a rear part of the air cleaner to be arranged from the left to the right, and then passes on a side surface at the rear part of the air cleaner to be connected to the primary delivery pipe located at a lower part.

Further, in the fuel supply apparatus of an internal combustion engine of the present invention, the first fuel supply pipe and the joint thereof arranged on an upper surface of the rear part of the air cleaner are arranged below a straight line in contact with an upper surface of the air cleaner and an upper surface of the fuel tank in a side view, and a recessed portion that houses the first fuel supply pipe and the joint thereof is provided in the upper surface of the rear part of the air cleaner.

DETAILED DESCRIPTION OF THE PREFERRED EMBODIMENTS

Hereinafter, a preferred embodiment of a fuel supply apparatus of an internal combustion engine in the present invention will be described on the basis of the drawings.

Figure 1:
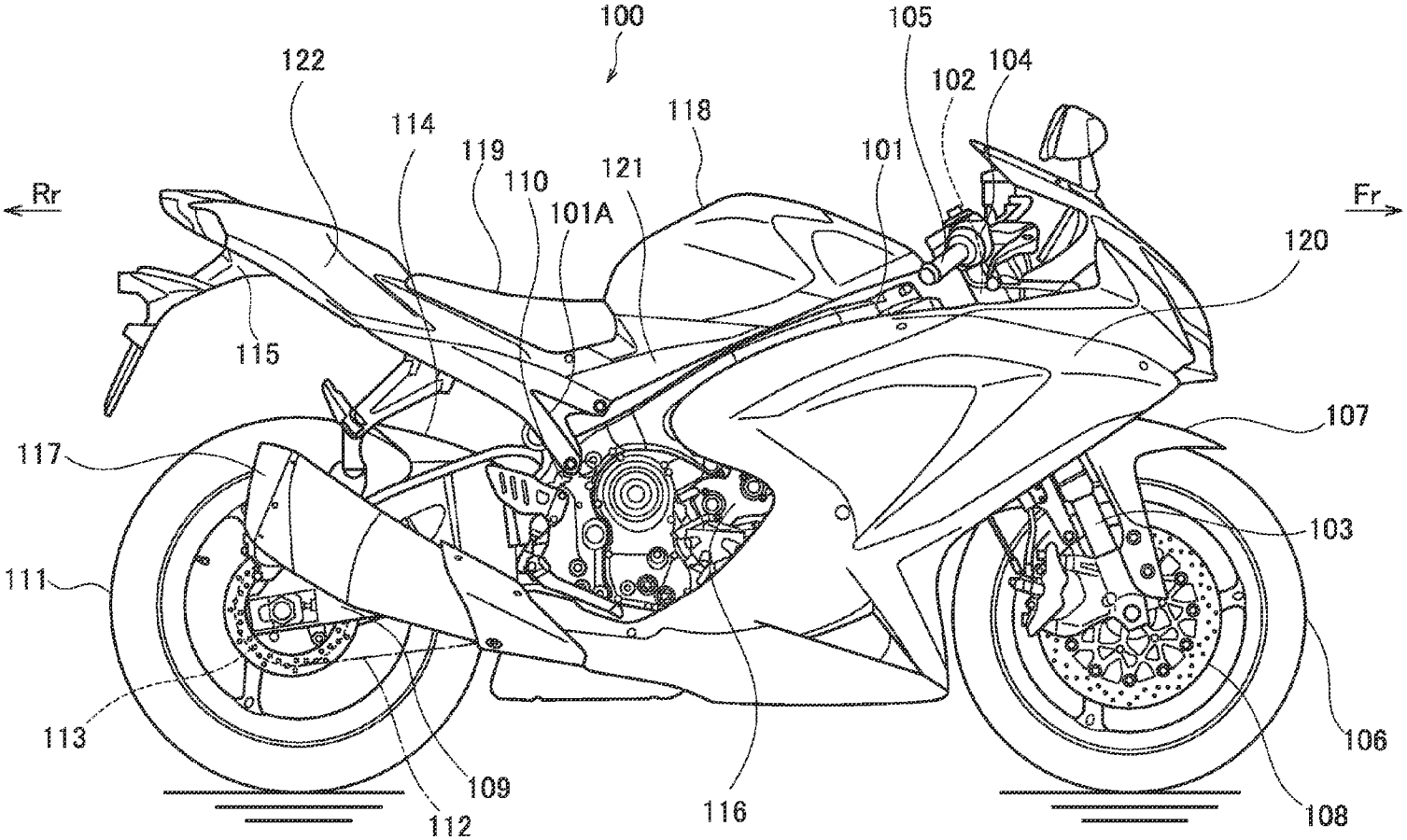
FIG. 1 is a side view of a motorcycle according to an embodiment of the present invention.

FIG. 1 is a side view of a motorcycle 100 as an application example of the present invention. First, an entire structure of the motorcycle 100 will be described using FIG. 1. Note that in the drawings including FIG. 1 used in the following explanation, as necessary, the front of a vehicle is indicated by an arrow Fr and the rear of the vehicle is indicated by an arrow Rr, and a lateral right side of the vehicle is indicated by an arrow R, and a lateral left side of the vehicle is indicated by an arrow L.

In FIG. 1, at front parts of a vehicle frame 101 (main frame) 101 made of steel or an aluminum alloy material, two right and left front forks 103 are provided that are supported to be turnable right and left by means of a steering head pipe 102. A handle bar 104 is fixed to upper ends of the front forks 103, and grips 105 are provided at both ends of the handle bar 104. A front wheel 106 is rotatably supported on lower portions of the front forks 103, and a front fender 107 is fixed at the lower portions of the front forks 103 so as to cover an upper portion of the front wheel 106. The front wheel 106 has a brake disk 108 that rotates integrally with the front wheel 106.

The vehicle frame 101 is integrally connected with a rear part of the steering head pipe 102 and branched rearward into a two-pronged shape of a right and left pair, and extend from the steering head pipe 102 while widening downward and rearward. In this example, the vehicle frame 101 is a so-called twin spar frame which is employed as a preferable one in a vehicle required to have a high-speed performance. Note that a seat rail 101A extends inclining properly to rise rearward from the vicinity of the rear part of the vehicle frame 101 and supports a later-described seat. Further, a swing arm 109 is swingably coupled to a rear part of the vehicle frame 101, and a rear shock absorber 110 is laid between them. A rear wheel 111 is rotatably supported on a rear end of the swing arm 109. The rear wheel 111 is configured to be rotationally driven via a driven sprocket 113 around which a chain 112 that transmits motive power of a later-described engine is wound. An inner fender 114 that covers the vicinity of a front upper portion of the rear wheel 111 is provided closely around the rear wheel 111, and a rear fender 115 may be disposed above the inner fender 114.

An air-fuel mixture made by mixing air and fuel supplied from not-illustrated air cleaner and fuel supply apparatus (these will be described later) respectively is supplied to an engine unit 116 mounted on the vehicle frame 101, and an exhaust gas after combustion in the engine passes through an exhaust pipe and is exhausted from a muffler 117. A fuel tank is mounted above the engine unit 116, and the fuel tank is covered with a tank cover 118. A seat 119 is provided continuously to the rear of the fuel tank.

As for the exterior of the vehicle, a fairing 120 and side cowls 121 mainly cover a front part and side parts of the vehicle, and a side cover or a seat cowl 122 is attached to a rear part of the vehicle, so that those exterior members form an external appearance form of the vehicle having a so-called streamline shape.

Figure 2:
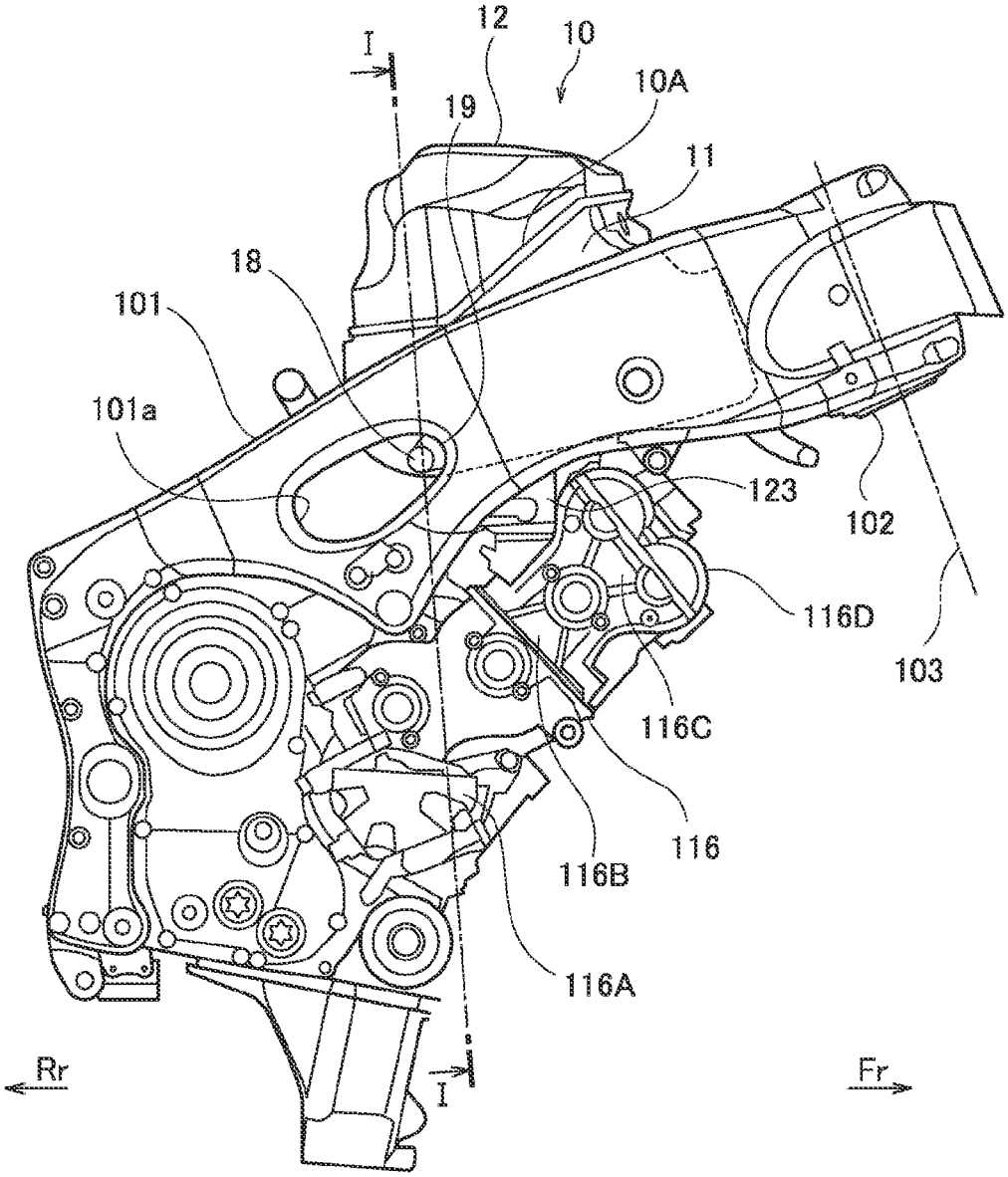
FIG. 2 is a side view in a state that an engine unit and an air cleaner are mounted on a vehicle frame in the embodiment of the present invention.

In this embodiment, the engine of the engine unit 116 may be, for example, a four-cycle multicylinder, typically, a parallel four-cylinder engine. Here, the engine unit 116 in this embodiment is configured such that a cylinder block 116B, a cylinder head 116C and a cylinder head cover 116D are integrally coupled in sequence on an upper part of a crankcase 116A as illustrated in FIG. 2. Further, the engine unit 116 is suspended from the vehicle frame 101 via a plurality of engine mounts and thereby integrally coupled to and supported by the vehicle frame 101 and functions as a rigid member of the vehicle frame 101 in itself.

Figure 3:
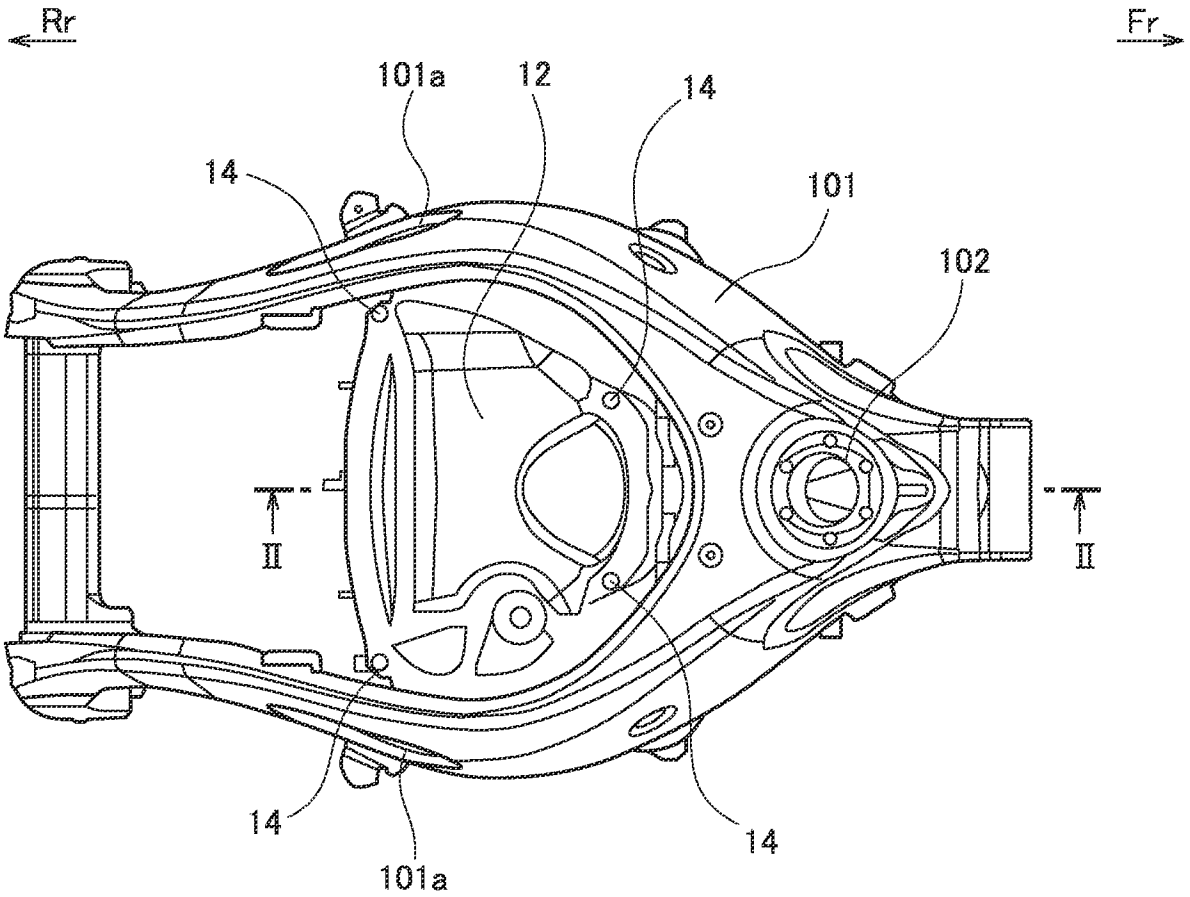
FIG. 3 is a top view in a state that the engine unit and the air cleaner are mounted on the vehicle frame in the embodiment of the present invention.
Figure 4A:
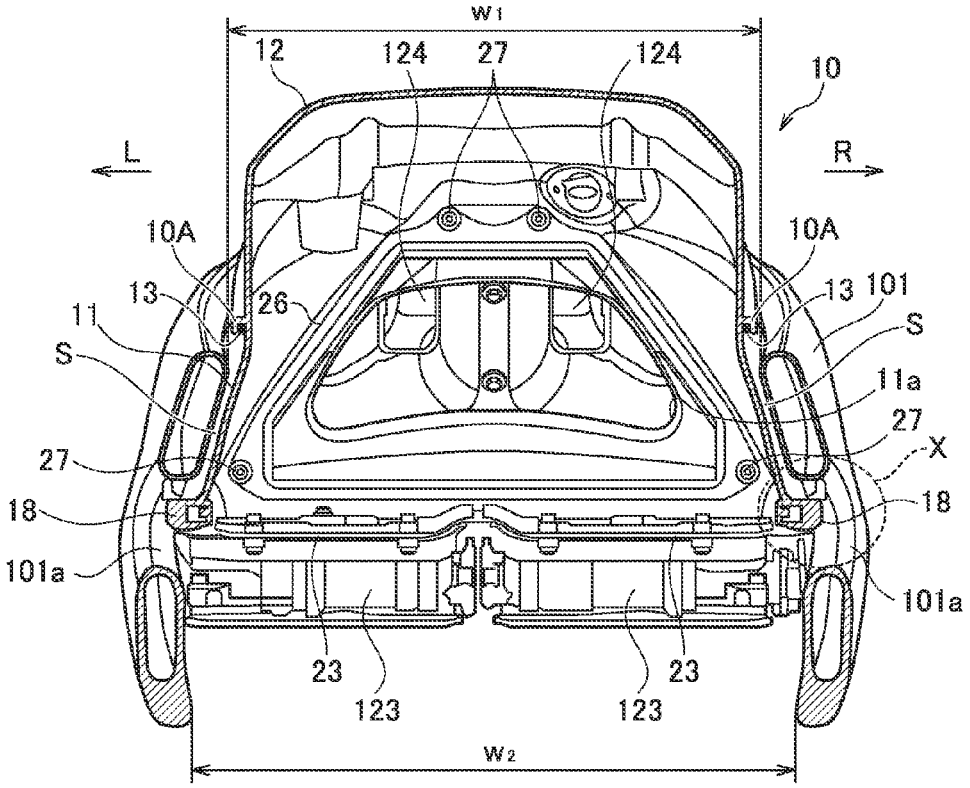
FIG. 4A is a cross-sectional view taken along a I-I line in FIG. 2.

In FIG. 2 and FIG. 3, the right and left pair of vehicle frame 101 extend from the steering head pipe 102 slightly downward to the rear. As illustrated in FIG. 3, the width between right and left inner surfaces of the vehicle frame 101 smoothly and gradually increases rearward from the steering head pipe 102 as illustrated in FIG. 3, and thus has an interspace or a space typically, though partially, forming an egg shape or a water drop shape. The vehicle frame 101 has a top-bottom direction width that is substantially the same as an axial length of the steering head pipe 102 as illustrated in FIG. 2. In this case, the vehicle frame 101 is formed to be smaller in width at the upper side than at the lower surface side as illustrated in FIG. 4A, namely, to be in an inverted V-shape with the upper surfaces thereof narrowed inward. In short, the vehicle frame 101 is configured such that an inner width $w_1$ on the upper surface side is set to be smaller than an inner width $w_2$ on the lower surface side in the vehicle width direction.

Figure 5:
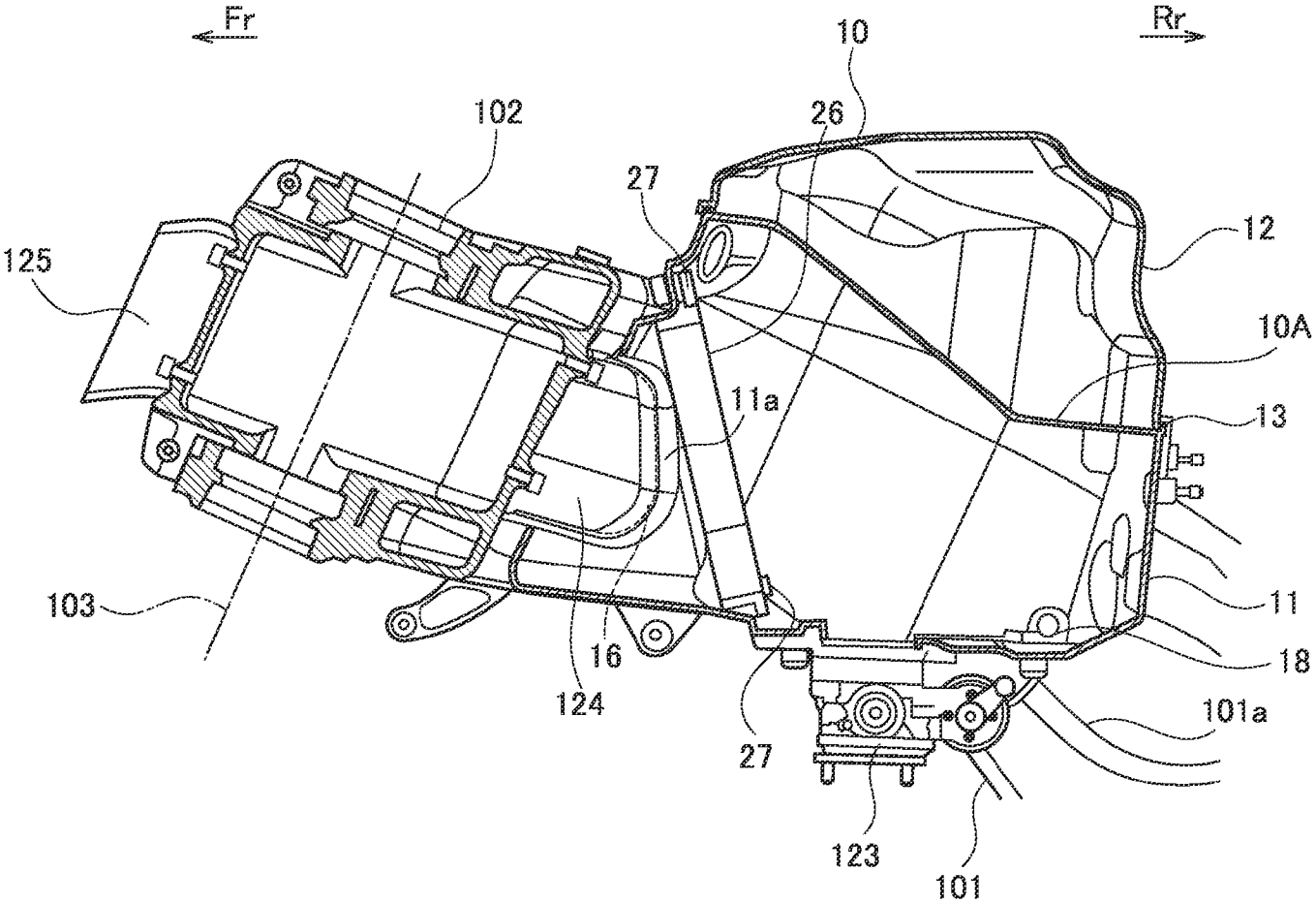
FIG. 5 is a cross-sectional view taken along a II-II line in FIG. 3.

In the interspace or space formed between the right and left portions of the vehicle frame 101 having the above-described form, an air cleaner 10 is housed and arranged as in FIG. 4A and FIG. 5 and so on. The air cleaner 10 and the engine unit 116, in particular, the cylinder head 116C are connected by throttle bodies constituting intake devices. Air cleaned by the air cleaner 10 is taken in by the intake devices and the fuel is supplied from the fuel supply apparatus, whereby the air-fuel mixture at a predetermined mixture ratio is fed to an intake port of the cylinder head 116C. As is clear also from FIG. 2, the air cleaner 10 is located above the cylinder head 116C. In an intake passage that links an engine combustion chamber communicating with the intake port to the air cleaner 10, throttle bodies 123 are arranged in a vertical posture in the substantially vertical direction as illustrated in FIG. 2 or FIG. 5, namely, this embodiment has a down draft type intake structure.

Figure 6:
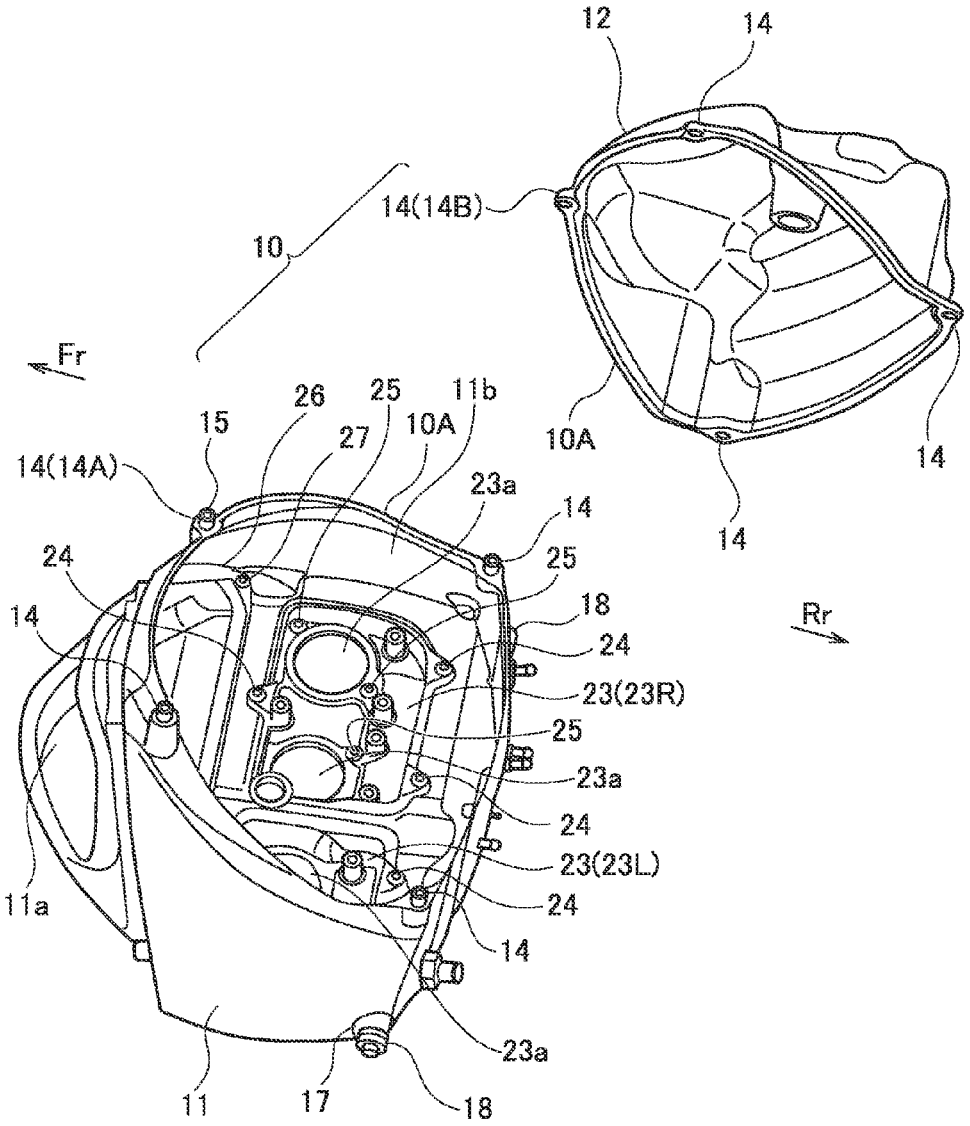
FIG. 6 is an exploded perspective view of the air cleaner when bottom plates and so on are attached in the embodiment of the present invention.
Figure 7:
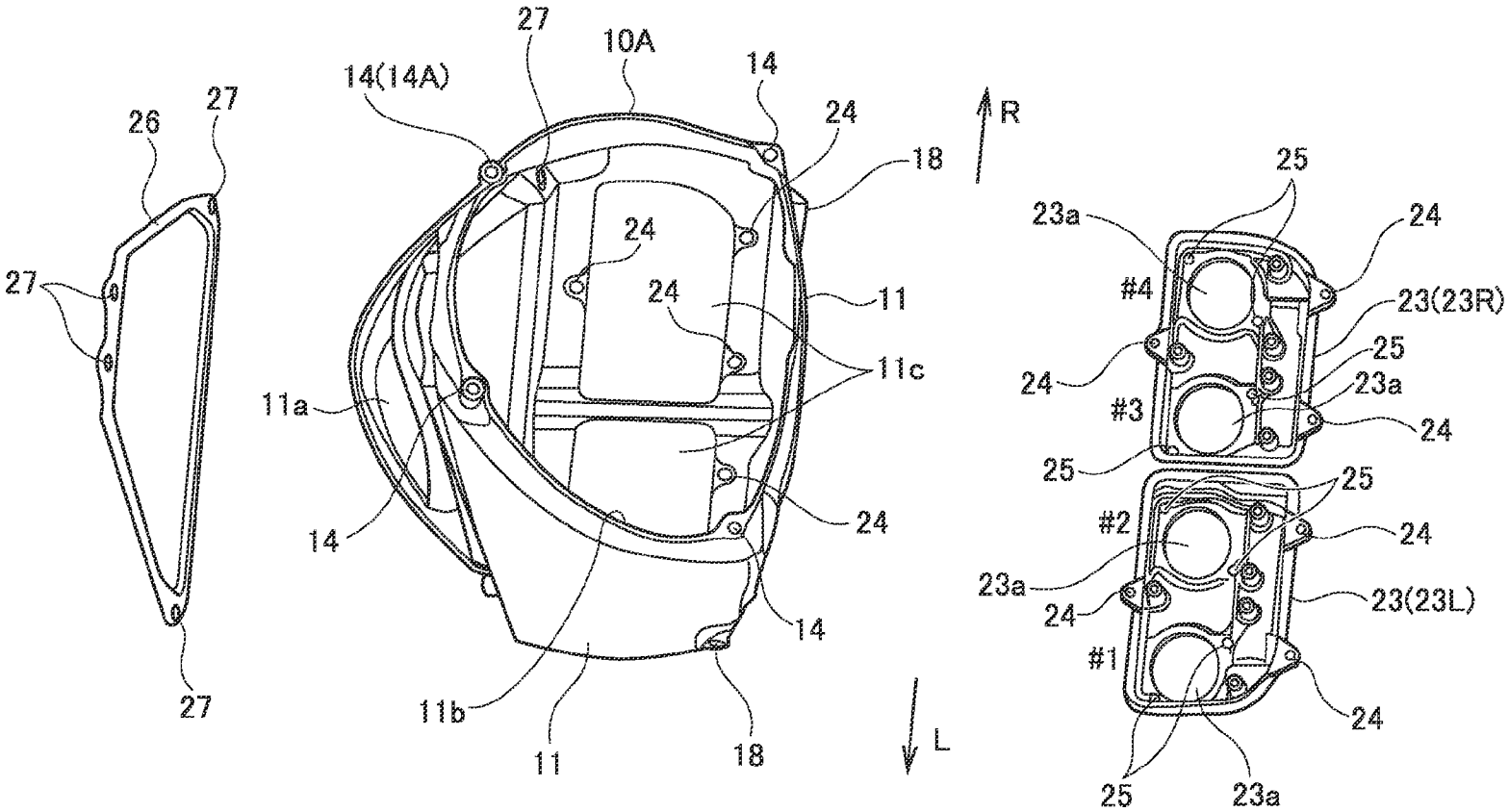
FIG. 7 is an exploded perspective view of the air cleaner when the bottom plates and so on are detached in the embodiment of the present invention.

Here, FIG. 6 and FIG. 7 illustrate a concrete configuration example of the air cleaner 10 in this embodiment. The air cleaner 10 includes an air cleaner body 11 and an air cleaner upper lid 12 which are divided into two upper and lower halves, both of which are combined into one body to form an almost deformed box shape. The front surface, the upper surface and the bottom surface of the air cleaner body 11 are provided with opening portions 11*a*, 11*b* and 11*c* respectively. To the opening portion 11*b* in the upper surface, among them, of the air cleaner body 11, a seal member 13 (FIG. 5) is attached and the air cleaner upper lid 12 is mounted, and both of them are fastened with bolts to close the opening portion 11*b*. In this case, the air cleaner 10 has a plurality of (four in this example) fastening parts 14 whose fastening bosses 14A are formed at the air cleaner body 11 and thus has threaded portions into which bolts 15 are screwed as illustrated in FIG. 6 and FIG. 7. Further, on the air cleaner upper lid 12, fastening flange portions 14B are projectingly provided and have openings into which the bolts 15 are inserted. Fastening the four fastening parts 14 firmly couple the air cleaner body 11 and the air cleaner upper lid 12.

The opening portion 11*a* in the front surface of the air cleaner body 11 is formed to be long in the right-left direction as illustrated in FIG. 4A so that air is introduced into the opening portion 11*a* from intake ducts 124 illustrated in FIG. 4A and FIG. 5 and so on. In other words, the opening portion 11*a* in the front surface is configured as an air introduction port. As illustrated in FIG. 5, an intake port 125 communicating with the intake ducts 124 is opened at a front part of the steering head pipe 102. The intake ducts 124 communicating with the intake port 125 are routed around from both right and left sides of the steering head pipe 102 and joined together at the rear part thereof, and connected to the opening portion 11*a* of the air cleaner body 11. The opening portion 11*a* of the air cleaner body 11 is inserted into the intake ducts 124 via rubber seals 16 being seal members and fixed in a floating manner as illustrated in FIG. 5.

Figure 4B:
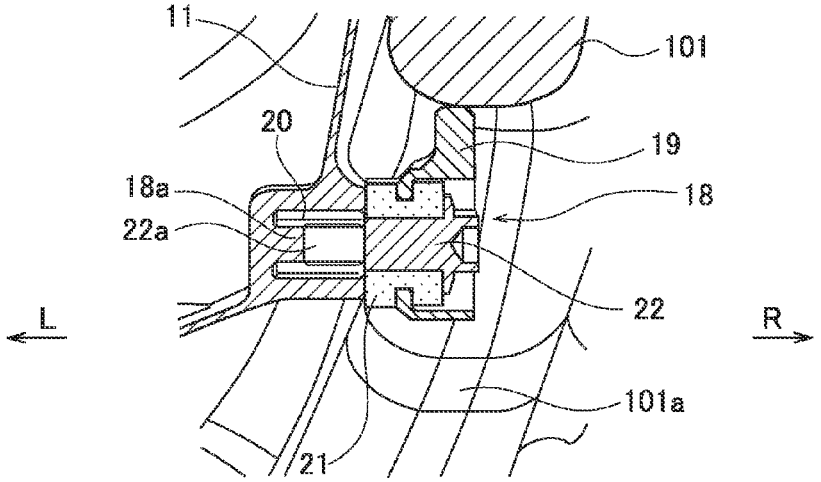
FIG. 4B is an enlarged view of an X part in FIG. 4A.

Further, as illustrated in FIG. 6 and so on, the air cleaner 10 has a right and left pair of fastening parts 18 to the vehicle frame 101 at lower corner parts 17 (only the one on the left side of the right and left pair is illustrated in FIG. 6) near the rear end on the outside surface of the air cleaner body 11, and is supported, at the fastening parts 18, in a floating manner by fastening brackets 19 (see FIG. 2) projectingly provided on the vehicle frame 101. More specifically, the fastening bracket 19 extends in a window part 101*a* formed in the vehicle frame 101 as illustrated in FIG. 2, and the fastening bracket 19 projects from the window part 101*a* in a side view. FIG. 4B illustrates a detailed structure of the fastening part 18, in which an insert nut 20 is embedded in the fastening part 18. To the fastening bracket 19, a cushion 21 is attached, and a fastening bolt 22 inserted in the cushion 21 is screwed together with the insert nut 20. In this case, a threaded portion 22*a* of the bolt 22 comes into contact with a seat 18*a* provided in the fastening part 18 and thereby fastens the cushion 21 with an appropriate force amount and supports the fastening part 18 without backlash.

As illustrated in FIG. 6 and FIG. 7, in the opening portions 11*c* in the bottom surface of the air cleaner body 11, air cleaner bottom plates 23 are fastened to the air cleaner body 11 via seal members. In the parallel four-cylinder engine in this embodiment, #1 to #4 cylinders (note that simply described as "#1" and so on in the following description) are arranged from the left in the right-left (vehicle width) direction (see FIG. 8). Though the throttle body 123 is connected to each of the cylinders, adjacent throttle bodies in combination are coupled together via a bracket and formed into a unit. In other words, the four throttle bodies 123 are divided into two blocks such as a set of #1 and #2 and a set of #3 and #4. The air cleaner 10 has the two left and right opening portions 11*c* for an air cleaner bottom plate 23L corresponding to #1 and #2 and an air cleaner bottom plate 23R corresponding to #3 and #4. Each of the air cleaner bottom plates 23 uses bolts as fastening means and is fastened to the air cleaner body 11 at three fastening parts 24 in this example.

In each of the air cleaner bottom plates 23, passage holes 23*a* that link the engine combustion chamber to the inside of the air cleaner body 11 are formed so that the intake air flows via the passage holes 23*a*. Each of the air cleaner bottom plates 23 is further fastened to the corresponding throttle body 123 at two fastening parts 25 in this example set near the outer peripheral portion of the passage hole 23*a* for each throttle body 123. Also at the fastening parts 25, bolts are used as fastening means. As illustrated in FIG. 4A and FIG. 5, the air cleaner body 11 is coupled to the upper end portions of the throttle bodies 123, and the air cleaner bottom plates 23 are directly coupled to the throttle bodies 123, and the passage holes 23*a* are arranged to align with the intake passages of the throttle bodies 123.

Further referring to FIG. 6 and FIG. 7, an air filter 26 is attached between the opening portion 11*a* in the front surface of the air cleaner body 11 and the opening portions 11*c* in the bottom surface, obliquely directed in the direction of the opening portion 11*b* being a substantially upper surface. The air filter 26 is formed in a mound shape, namely, to be narrower on the upper portion side as illustrated in FIG. 4A and so on, and fastened to the air cleaner body 11 at four fastening parts 27 in this example. Also at the fastening parts 27, bolts are used as fastening means.

In the above case, a not-illustrated fuel tank is mounted and supported on the rear side of the air cleaner 10 mounted on the vehicle frame 101. The fuel tank and the air cleaner 10 are integrally covered with a tank cover 118 as a whole.

Further, the shape of a portion of the air cleaner body 11 overlapping with the vehicle frame 101 in a side view in FIG. 2, namely, arranged inside the vehicle frame 101 as illustrated in FIG. 4A is formed such that the upper surface portion is narrower than the bottom surface portion. In this case, substantially uniform gaps S are formed along and between the outside surface of the air cleaner body 11 and the inner surfaces of the vehicle frame 101. Further, the air cleaner upper lid 12 coupled to the opening portion 11*b* in the upper surface of the air cleaner body 11 has a planar shape equal to or less than the opening portion 11*b* as is found from FIG. 4A or FIG. 6 or the like. In other words, the whole air cleaner 10 is formed to fit inside the inner width between the right and left portions of the vehicle frame 101.

Figure 8:
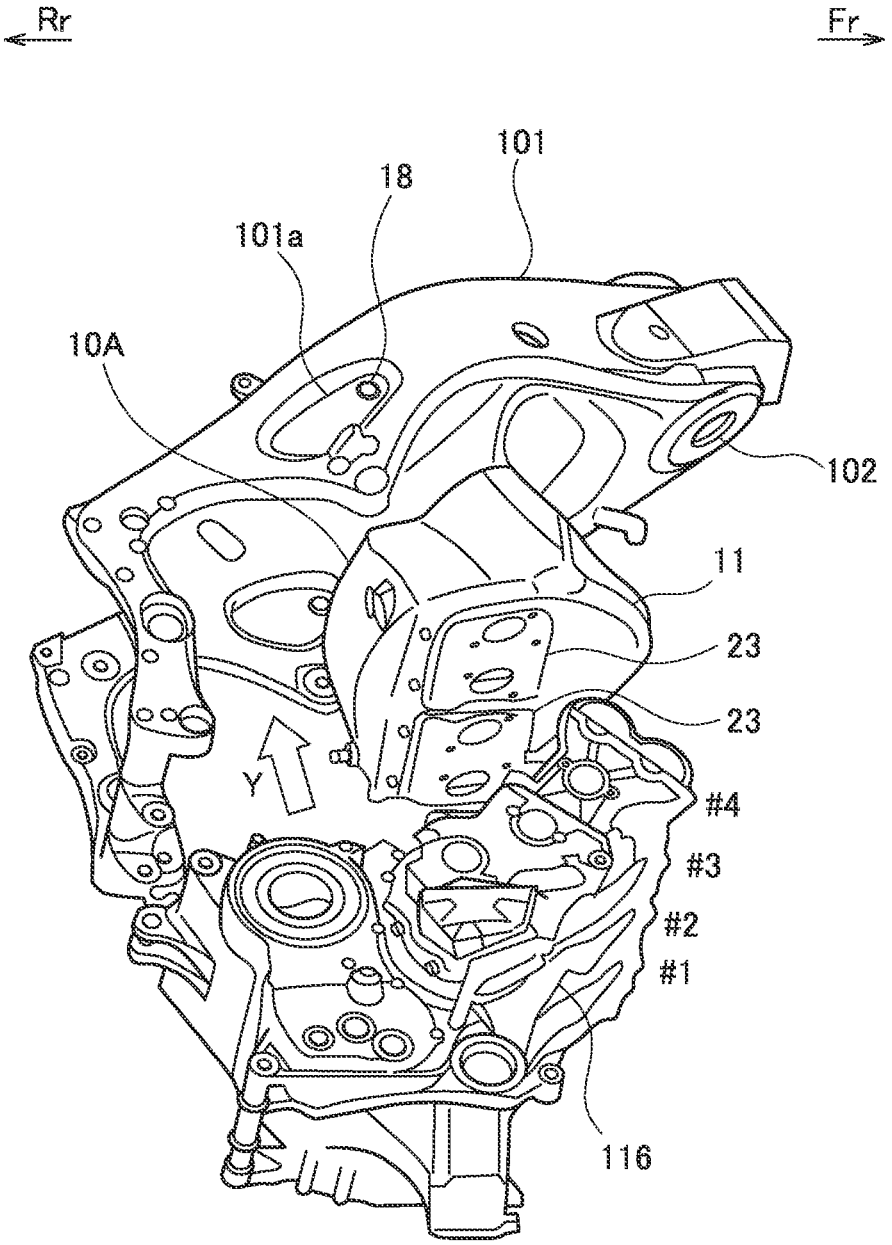
FIG. 8 is a perspective view illustrating an assembly process of the air cleaner and so on in the embodiment of the present invention.

Here, the air cleaner body 11 is inserted from below (namely, the wider side of) the vehicle frame 101 (an arrow Y in FIG. 8) before the engine unit 116 is mounted, and fixed to the vehicle frame 101 in assembly of the air cleaner 10 and so on as illustrated in FIG. 8. The air cleaner body 11 is set to be narrower on its upper surface side and to ensure the gaps S with respect to the inner surfaces of the vehicle frame 101, and therefore can be effortlessly and appropriately inserted and assembled to the vehicle frame 101 being the twin spar frame.

The twin spar frame reduces the frontal projected area of the vehicle and thereby improves the aerodynamic performance. The twin spar frame further enhances the degree of freedom at riding of a rider to improve the riding property, thereby making it possible to provide the motorcycle 100 equipped with the wide parallel multicylinder engine while improving both the aerodynamic performance and the riding property.

Further, twist, horizontal and longitudinal stiffness adjustment of the vehicle frame 101 can be easily performed depending on the characteristics of the vehicle (performance requirement).

Figure 9:
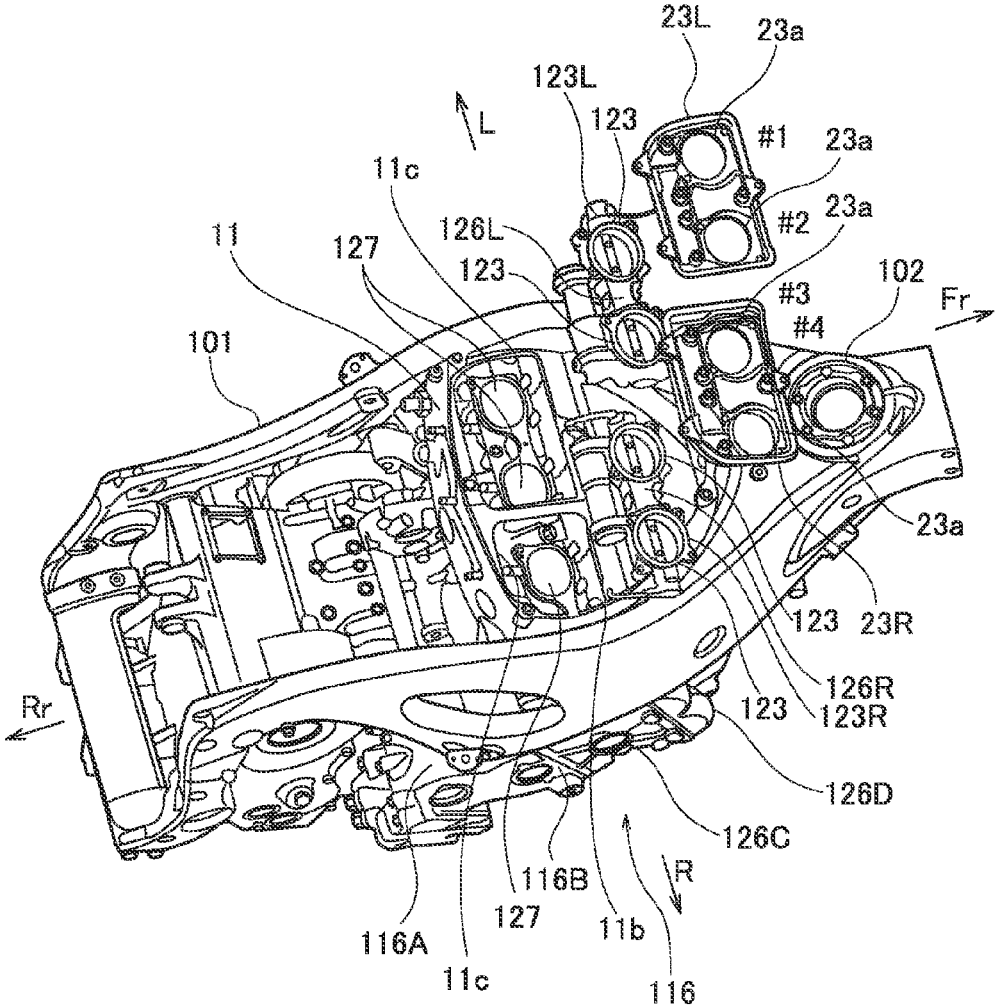
FIG. 9 is an exploded perspective view of the air cleaner and so on mounted on the vehicle frame in the embodiment of the present invention.

Further referring to FIG. 9, the throttle bodies 123 of #1 and #2 corresponding to the air cleaner bottom plate 23L are coupled together via a bracket 126L into a unit (assumed as a throttle body 123L). The lower end side of the throttle body 123L is connected to intake ports 127 of #1 and #2 communicating with the engine combustion chamber at the cylinder head 116C. Further, the throttle bodies 123 of #3 and #4 corresponding to the air cleaner bottom plate 23R are coupled together via a bracket 126R into a unit (assumed as a throttle body 123R). The lower end side of the throttle body 123R is similarly connected to intake ports 127 of #3 and #4.

The throttle bodies 123 can be attached to and detached from the intake ports 127. The left and right opening portions 11*c* of the air cleaner body 11 corresponding to the throttle body 123L and the throttle body 123R have shapes and dimensions required for the throttle body 123L and the throttle body 123R to pass therethrough.

As described above, the front surface, the upper surface and the bottom surface of the air cleaner body 11 are provided with opening portions 11*a*, 11*b* and 11*c* respectively. To the opening portion 11*b* in the upper surface, among them, of the air cleaner body 11, the seal member 13 (FIG. 5) is attached and the air cleaner upper lid 12 is mounted, and both of them are fastened with bolts to close the opening portion 11*b*.

When detaching the air cleaner upper lid 12, the bolts 15 in the fastening parts 14 are accessed from above and loosened, whereby the air cleaner upper lid 12 can be easily detached. This opens the inside of the air cleaner body 11 and enables a maintenance work and so on to be easily and smoothly performed in this state. In short, the air cleaner upper lid 12 functions as a so-called maintenance cap and can greatly improve the maintainability.

Further, the air cleaner bottom plates 23 having the passage holes 23*a* are fastened to the opening portions 11*c* in the bottom surface of the air cleaner body 11.

Removing the air cleaner bottom plates 23 opens the opening portions 11*c* in the bottom surface to expose the throttle body 123L and the throttle body 123R in the left and right opening portions 11*c* respectively. The throttle body 123L and the throttle body 123R can be taken out through the left and right opening portions 11*c* respectively. As described above, it is unnecessary to remove the air cleaner body 11 and detach the engine unit 116 from the vehicle frame 101 in order to detach the throttle bodies 123 sandwiched between the engine side and the air cleaner body 11.

Further, the throttle bodies 123 are divided in a predetermined combination, and the air cleaner bottom plates 23 and the opening portions 11*c* corresponding thereto are also divided.

In this example, the air cleaner bottom plates 23 and the throttle bodies 123 are divided into two right and left blocks, thereby making it possible to attach and detach the components such as the throttle body 123L and the throttle body 123R even with a relatively small opening portion 11*b* in the upper surface of the air cleaner body 11. The air cleaner body 11, if formed to be in a shape (with a cross section of an inverted V-shape) with the upper portion thereof narrowed conforming to the vehicle frame 101, ensures excellent component attachability and detachability and exhibit a high effect when it is applied to the twin spar frame.

Note that in the case where the shape of the air cleaner body 11 is not narrowed upward, there is substantially no problem even if the air cleaner bottom plates 23 and the throttle bodies 123 are not divided into two blocks.

Further, the air cleaner bottom plates 23 are fastened to the throttle bodies 123 fixed to the engine side, whereby the engine and the air cleaner body 11 are integrally fixed. This ensures the positional and dimensional accuracies of the passage holes 23*a* that link the engine combustion chamber to the air cleaner body 11 to ensure the excellent intake performance.

Figure 10B:
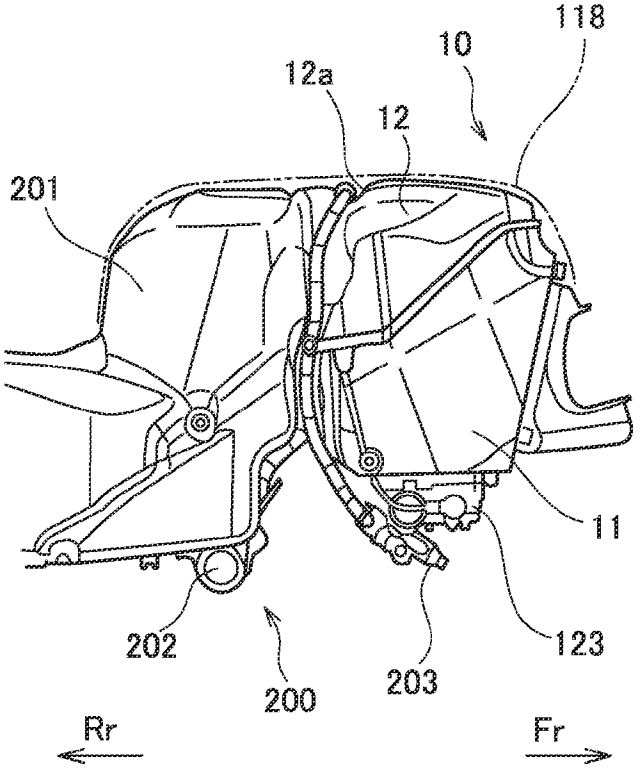
FIG. 10B is a right side view illustrating the schematic configuration of the fuel supply apparatus in the embodiment of the present invention.
Figure 10A:
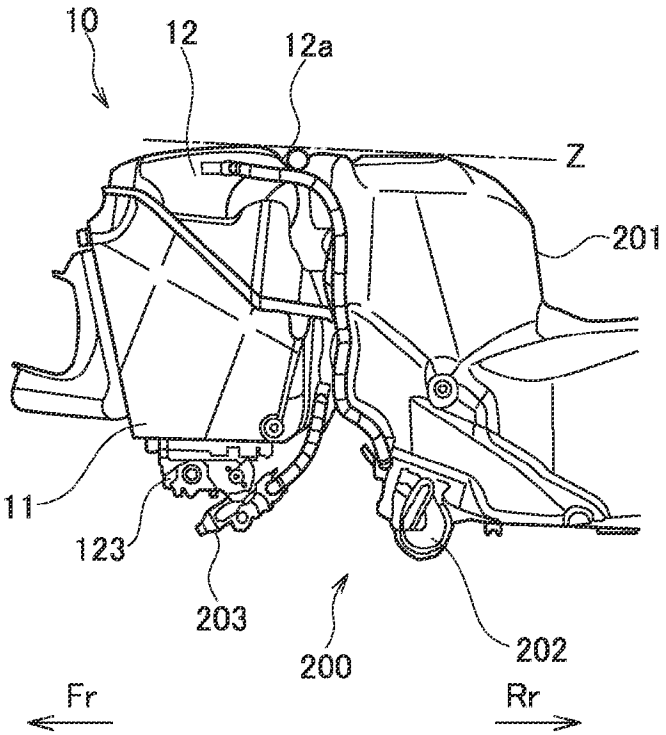
FIG. 10A is a left side view illustrating a schematic configuration of a fuel supply apparatus in the embodiment of the present invention.
Figure 11:
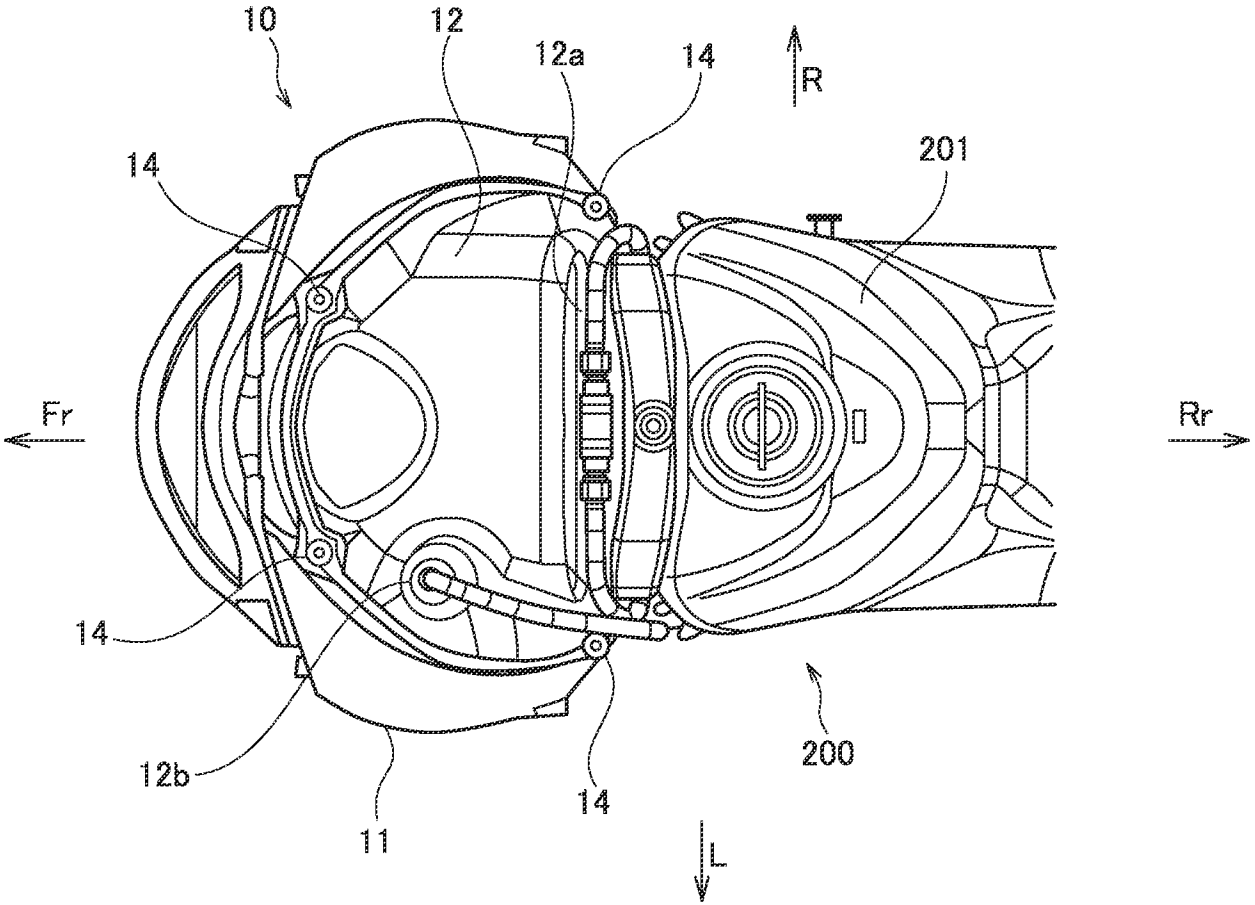
FIG. 11 is a top view illustrating a schematic configuration of the fuel supply apparatus in the embodiment of the present invention.

Incidentally, the fuel supply apparatus of the present invention is typically applied to the engine unit 116 being the internal combustion engine together with the above-described air cleaner 10. FIG. 10A, FIG. 10B and FIG. 11 illustrate a schematic configuration of a fuel supply apparatus 200 in this embodiment. In the fuel supply apparatus 200, a fuel tank 201 is arranged adjacent on a vehicle rear of the air cleaner 10, and a fuel pump 202 is attached to the lower surface of the fuel tank 201. In this embodiment, two kinds of injectors that inject fuel to an intake system are provided, namely, each cylinder has a plurality of injectors composed of a primary injector and a secondary injector. Among them, the primary injector 203 is arranged on the downstream of a throttle valve attached to the throttle body 123 as illustrated in FIG. 10A, FIG. 10B, and the secondary injector is housed and arranged in the air cleaner 10 as will be described later. The fuel pump 202 and the injector and so on are connected by a fuel pipe so that the fuel discharged from the fuel pump 202 is supplied via the fuel pipe to the primary injector 203 and so on. Note that the air cleaner 10 and the fuel tank 201 are integrally covered with the tank cover 118 (also see FIG. 1) as roughly illustrated in FIG. 10B.

Figure 12:
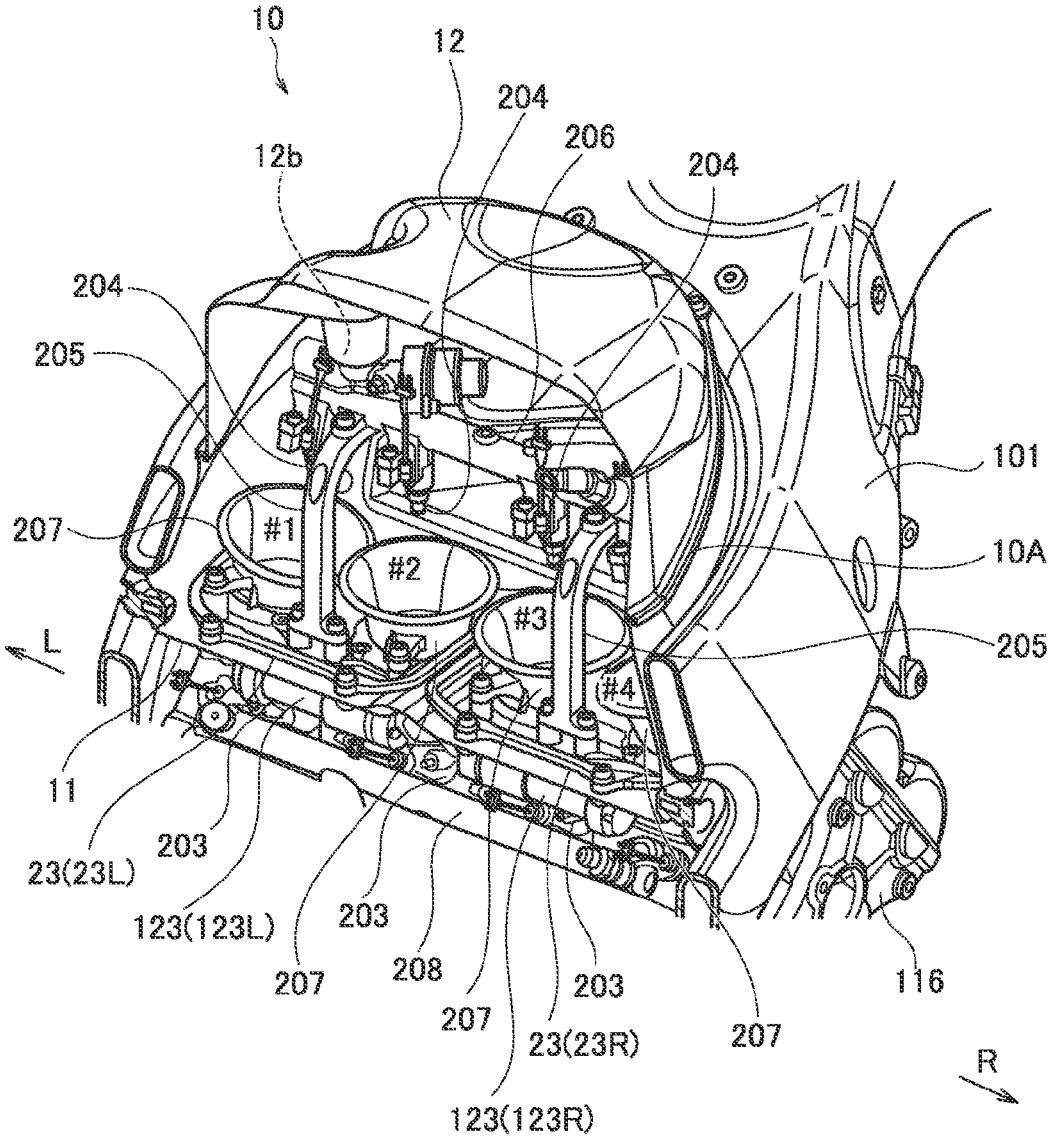
FIG. 12 is a broken perspective view illustrating a configuration example of the fuel supply apparatus inside the air cleaner in the embodiment of the present invention.

Here, components such as the secondary injectors 204 and so on are arranged inside the air cleaner 10 as illustrated in FIG. 12. The secondary injector 204 is provided for each of the #1 to #4 cylinders, in which case the four secondary injectors 204 are mounted and supported along a secondary delivery pipe 206 laterally bridged in the vehicle width direction via a pair of pipe support posts 205. Each of the pipe support posts 205 is fastened to a predetermined region of the air cleaner bottom plate 23 (23R, 23L) and supports the secondary delivery pipe 206 at its tip end projectingly provided to overhang forward as illustrated in the drawing. Each of the secondary injectors 204 is attached above a later-described air funnel with its injection port directed downward so as to inject the fuel supplied from the secondary delivery pipe 206.

Further, an air funnel 207 is provided for each of the #1 to #4 cylinders, and each air funnel 207 is fastened to a predetermined region of the air cleaner bottom plate 23 (23R, 23L) in a manner to be aligned and communicate with the passage hole 23*a* of the corresponding air cleaner bottom plate 23. Note that the four air funnels 207 are arranged in the vehicle width direction at substantially the same pitch as the pitch between the cylinders. The air funnel 207 takes in air in the air cleaner 10 from the upper opening expanding in diameter in a horn shape, and the air is supplied to the throttle body 123 via the passage hole 23*a*. For each cylinder, the secondary injector 204 is arranged above the air funnel 207.

Further, a primary delivery pipe 208 is laterally bridged in the vehicle width direction as illustrated in FIG. 12 obliquely below the rear of the throttle bodies 123. Along the primary delivery pipe 208, the four primary injectors 203 are mounted and supported at the same pitch as the pitch between the cylinders. The primary delivery pipe 208 is connected to the fuel pump 202 via the fuel pipe as will be described later and is supplied with the fuel.

In the present invention, in particular, the secondary injector 204 that is one of the plurality of injectors provided for each cylinder is arranged above the air funnel 207 inside the air cleaner 10, and the secondary injector 204 and the air funnel 207 corresponding thereto are arranged to be inclined such that the base portion of the secondary injector 204 on the outer side in the vehicle width direction is biased to the center side in the vehicle width direction and its injection port is directed to the throttle body 123.

Figure 13A:
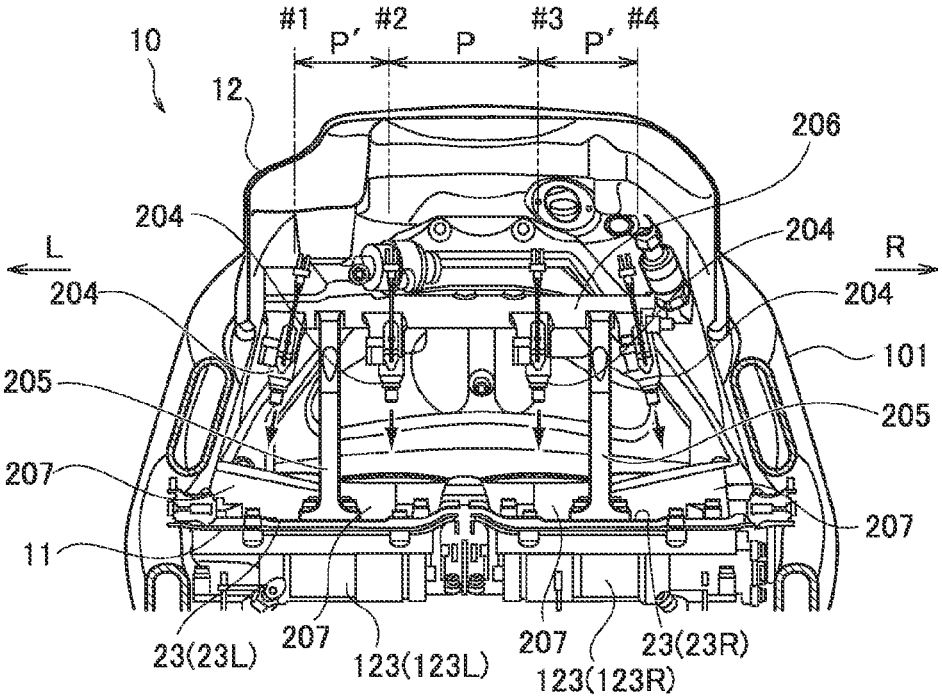
FIG. 13A is a longitudinal sectional view in a rear view illustrating a configuration example of the fuel supply apparatus inside the air cleaner in the embodiment of the present invention.
Figure 13B:
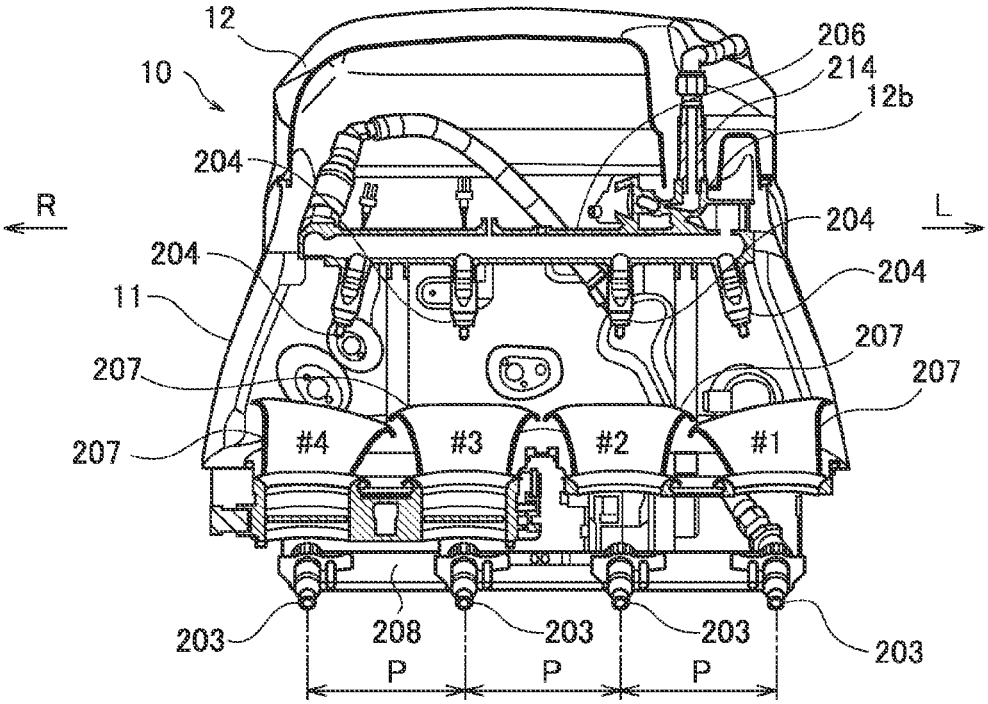
FIG. 13B is a longitudinal sectional view in a front view illustrating the configuration example of the fuel supply apparatus inside the air cleaner in the embodiment of the present invention.

More specifically, the secondary injector 204 of #1 is inclined with respect to the vertical direction such that its injection port side is biased leftward and the air funnel 207 of #1 facing the secondary injector 204 is inclined with respect to the vertical direction such that its upper open side is biased rightward as illustrated in FIG. 13A, FIG. 13B. In this case, the axes of the secondary injector 204 and the air funnel 207 substantially coincide with each other. Further, the secondary injector 204 of #4 is inclined with respect to the vertical direction such that its injection port side is biased rightward and the air funnel 207 of #4 facing the secondary injector 204 is inclined with respect to the vertical direction such that its upper open side is biased leftward. In this case, the axes of the secondary injector 204 and the air funnel 207 substantially coincide with each other. Note that the secondary injectors 204 of #2 and #3 and the air funnels 207 facing them are not inclined but substantially directed in the vertical direction.

Arranging the secondary injectors 204 of #1 and #4 inclined as described above makes an arrangement pitch P' between the secondary injectors 204 of #1 and #2 smaller than an arrangement pitch between the secondary injectors 204 of #2 and #3 (substantially the same as a pitch P between the cylinders) as illustrated in FIG. 13A. This also applies to the arrangement pitch P' between the secondary injectors 204 of #3 and #4, namely, the arrangement pitch is set to be smaller on both sides of the four secondary injectors 204.

Figure 14A:
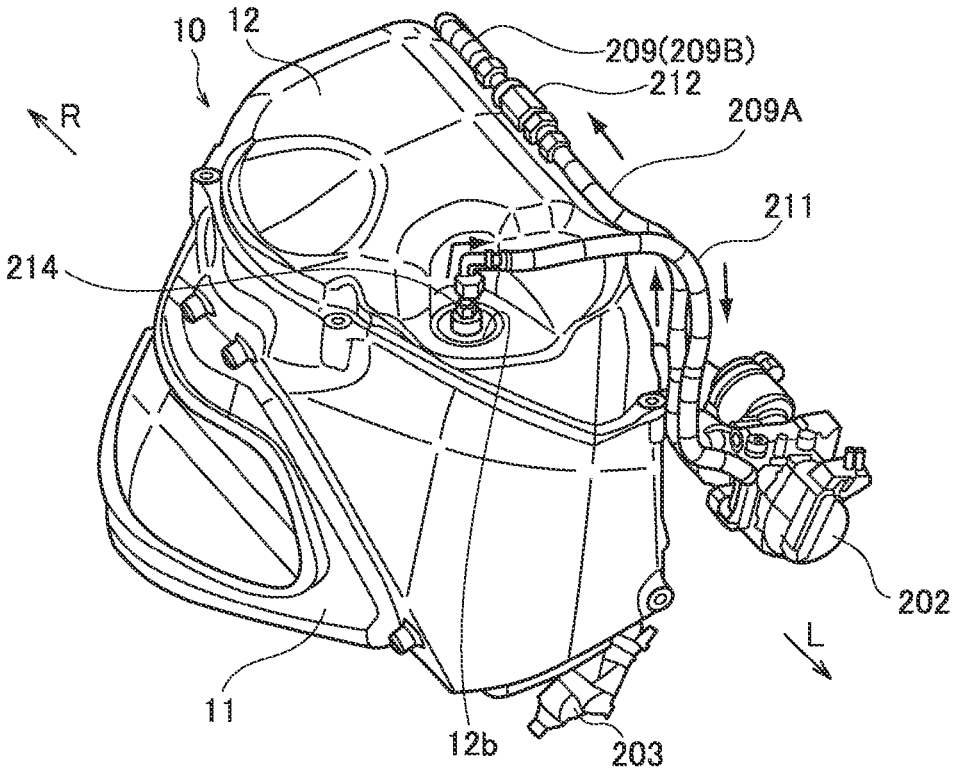
FIG. 14A is a perspective view when an air cleaner upper lid is attached illustrating an example of a fuel pipe structure in the embodiment of the present invention.
Figure 14B:
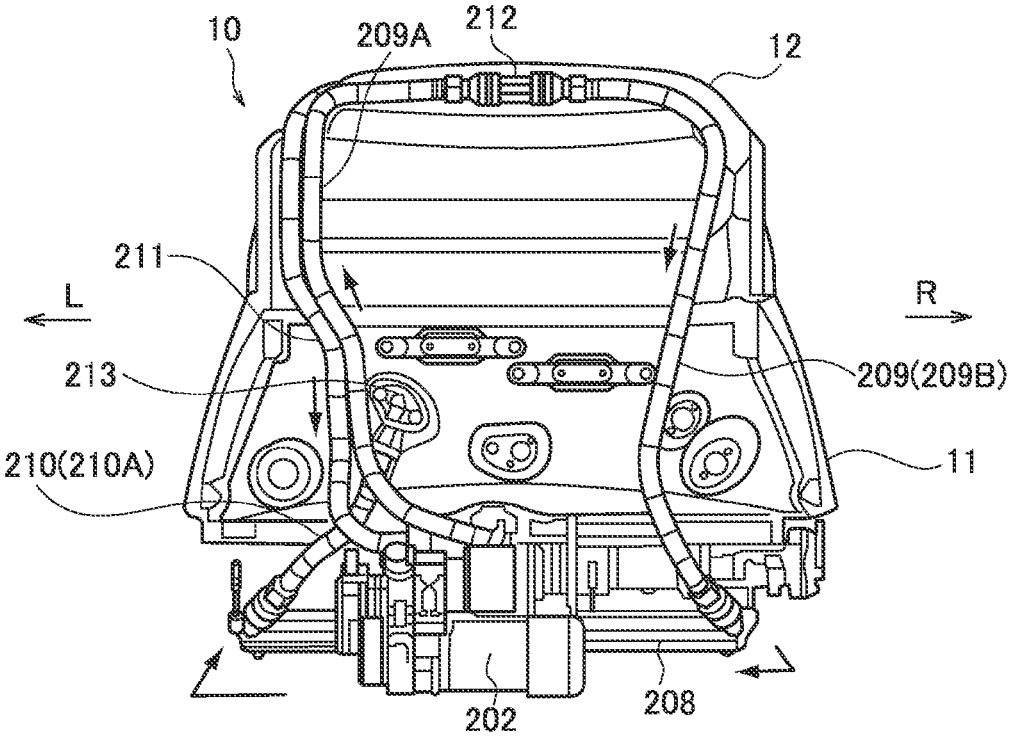
FIG. 14B is a rear perspective view when the air cleaner upper lid is attached illustrating the example of the fuel pipe structure in the embodiment of the present invention.
Figure 15A:
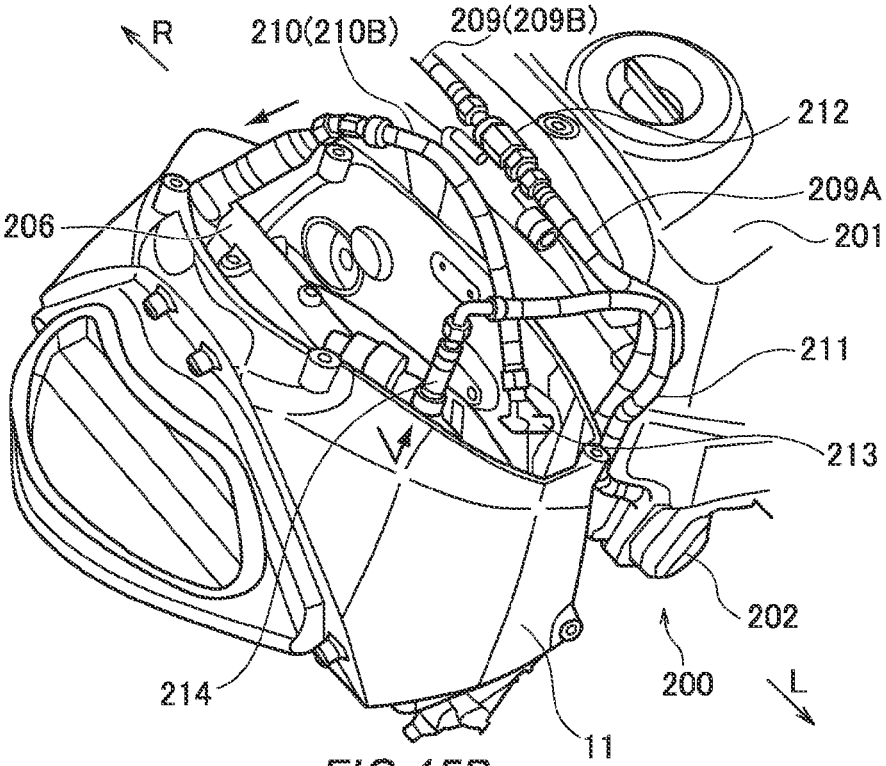
FIG. 15A is a perspective view when the air cleaner upper lid is detached illustrating the example of the fuel pipe structure in the embodiment of the present invention.
Figure 15B:
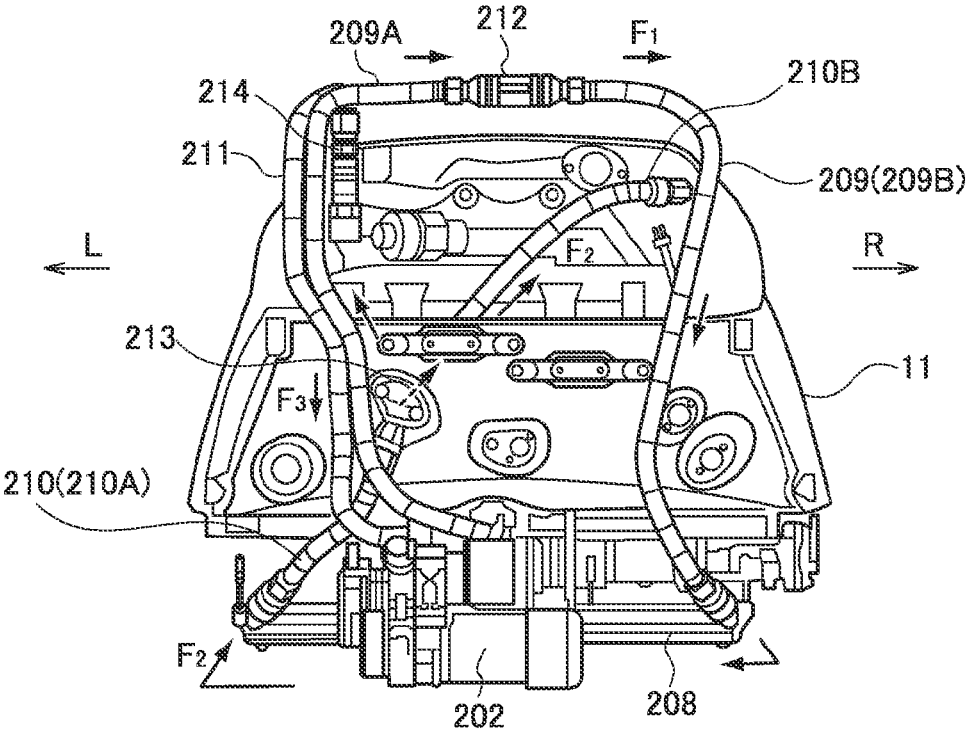
FIG. 15B is a rear perspective view when the air cleaner upper lid is detached illustrating the example of the fuel pipe structure in the embodiment of the present invention.

Next, an example of a fuel pipe structure arranged between the fuel pump 202 and the injectors and so on will be described referring mainly to FIG. 14A, FIG. 14 and FIG. 15A, FIG. 15B. FIG. 14A, FIG. 14B illustrate the air cleaner 10 when the air cleaner upper lid 12 is attached, and FIG. 15A, FIG. 15B illustrate the air cleaner 10 when the air cleaner upper lid 12 is detached. As for the main flow of a fuel supply system composed of the fuel supply apparatus 200 according to this embodiment, first, the fuel pump 202 sucks the fuel in the fuel tank 201, and the fuel discharged from the fuel pump 202 is supplied to the primary injectors 203 via the primary delivery pipe 208. Concurrently therewith, the fuel is discharged from the primary delivery pipe 208 to the secondary delivery pipe 206, and supplied to the secondary injectors 204 via the secondary delivery pipe 206. Thereafter, the fuel is returned from the secondary delivery pipe 206 to the fuel pump 202, and further to the fuel tank 201.

In the concrete fuel pipe structure for constituting the fuel supply system, a first fuel supply pipe 209 connected to the fuel pump 202 is connected to the one end side (right end) of the primary delivery pipe 208 that supplies the fuel to the primary injectors 203, and a second fuel supply pipe 210 connected the other end side (left end) of the primary delivery pipe 208 is connected to the one end side (right end) of the secondary delivery pipe 206. Further, a fuel feedback pipe 211 connected to the other end side (left end) of the secondary delivery pipe 206 is connected to the fuel pump 202.

In the above case, the first fuel supply pipe 209 is divided into two halves of a fuel supply pipe 209A and a fuel supply pipe 209B at an appropriate middle point via a joint clamp 212 (simply referred to as a joint) in a manner to be capable of being separated from and connected to each other. In this example, the first fuel supply pipe 209 is extended from the discharge port of the fuel pump 202 once in the left side direction in a rear view and arranged upward, then passes on the upper surface at the rear of the air cleaner 10 (air cleaner upper lid 12) to be arranged from the left to the right, and then passes on the side surface at the rear part of the air cleaner 10 to be connected to the primary delivery pipe 208 located at the lower part as illustrated in FIG. 14B and FIG. 15B.

In the case of arranging the first fuel supply pipe 209 as described above, referring to FIG. 10A, FIG. 10B and FIG. 11, a recessed portion 12*a* that houses the first fuel supply pipe 209 and the joint clamp 212 is provided in the upper surface of the rear part of the air cleaner upper lid 12. The first fuel supply pipe 209 and the joint clamp 212 arranged on the upper surface of the rear part of the air cleaner 10 as described above are arranged below a straight line Z in contact with the upper surface of the air cleaner 10 (air cleaner upper lid 12) and the upper surface of the fuel tank 201 in a side view as illustrated in FIG. 10A, namely, so as not to project above in a height direction with respect to both the air cleaner 10 and the fuel tank 201. Note that the first fuel supply pipe 209 (fuel supply pipe 209A) passes on the inner side in the vehicle width direction of the fuel feedback pipe 211 and is arranged upward as illustrated in FIG. 14B and FIG. 15B.

Further, the second fuel supply pipe 210 is inserted into the inside of the air cleaner 10 from the outside via a joint clamp 213 (simply referred to as a joint) and arranged inside the air cleaner 10. In other words, the second fuel supply pipe 210 is divided into two halves of a fuel supply pipe 210A and a fuel supply pipe 210B in a manner to be substantially capable of being separated from and connected to each other via the joint clamp 213.

Furthermore, a joint 214 of the secondary delivery pipe 206 is arranged in a manner to project from the air cleaner 10, concretely, a communication hole 12*b* in the upper surface of the air cleaner upper lid 12, corresponding to the other end side of the secondary delivery pipe 206 as illustrated in FIG. 11 or FIG. 13B or the like. Then, the fuel feedback pipe 211 is inserted from above and connected to the joint 214.

Explaining the basic operation of the fuel supply apparatus 200 configured as described above referring, for example, in particular, to FIG. 15A, FIG. 15B, the fuel pump 202 sucks the fuel in the fuel tank 201, and the fuel discharged from the fuel pump 202 is supplied to the primary delivery pipe 208 via the first fuel supply pipe 209 (FIG. 15B, arrow $F_1$). The fuel is distributed and supplied by the primary delivery pipe 208 to the primary injectors 203, and a predetermined amount of fuel is injected from the primary injectors 203 at a predetermined timing. The primary injectors 203 function for the engine low rotation and low load time, and are operated by a control signal of an ECU (engine control unit) mounted on the vehicle. The fuel in the primary delivery pipe 208 is supplied to the secondary delivery pipe 206 via the second fuel supply pipe 210 (FIG. 15B, arrow $F_2$). The fuel is distributed and supplied by the secondary delivery pipe 206 to the secondary injectors 204, and a predetermined amount of fuel is injected from the secondary injectors 204 at a predetermined timing. The secondary injectors 204 function for the engine high rotation and high load time, and are operated by a control signal of the ECU also in this case. The fuel is then returned from the secondary delivery pipe 206 to the fuel pump 202 via the fuel feedback pipe 211 (FIG. 15B, arrow $F_3$), and further to the fuel tank 201.

Next, main operation and effect of the fuel supply apparatus 200 of the present invention will be described. First, the base portions of the secondary injectors 204 of #1 and #4 are biased to the center side in the vehicle width direction, and the secondary injectors 204 and the air funnels 207 facing them are arranged to be inclined such that their injection ports are directed to the throttle bodies 123.

With the inclined arrangement, the upper lateral widths of the air cleaner 10 and the vehicle frame 101 can be narrowed to effectively realize the form of those members with their upper parts narrowed. This makes it possible to make, in particular, the vehicle compact in the right-left direction to improve the degree of freedom at riding of a rider.

Further, since the pitch P between the cylinders and the arrangement pitch between the throttle bodies 123 become the same as described above, resulting in a short and linear intake path. This makes it possible to effectively reduce the lateral width of the vehicle frame 101 while not sacrificing but improving the response and the output of the engine. Narrowing the lateral width of the vehicle can improve the aerodynamic performance.

Further, the secondary injectors 204 fasten and fix the pipe support posts 205 to the air cleaner bottom plates 23 via the secondary delivery pipe 206.

Such attachment structure enables attachment work of the secondary injectors 204 and the secondary delivery pipe 206 by accessing from above via the opening portion 11*b* in the upper surface of the air cleaner body 11. The structure allows the attachment work to be performed regardless of the air cleaner upper lid 12, and is therefore excellent in maintenability and workability.

Further, the main constituent members of the fuel supply system in this embodiment includes the fuel pump 202, the primary injectors 203, the primary delivery pipe 208, the secondary injectors 204, the secondary delivery pipe 206 and so on, and they are connected to each other by the first fuel supply pipe 209, the second fuel supply pipe 210 and the fuel feedback pipe 211.

Many members or components are provided in a small space, but the pipe structure is made under consideration of the assembly property and maintenability in the small space.

In this case, among the plurality of injectors provided for each cylinder, the primary injector 203 is used for the low rotation and low load time and the secondary injector 204 is used for the high rotation and high load time. By finely controlling each of the two kinds of injectors, fuel injection is performed at an appropriate timing and an appropriate flow rate to effectively improve the engine output performance and so on.

Further, the second fuel supply pipe 210 is inserted into the inside of the air cleaner 10 from the outside, in which case the fuel supply pipe 210B is arranged inside the air cleaner 10.

In assembly, access is made from above via the opening portion 11*b* in the upper surface of the air cleaner body 11, a pipe arrangement work around the fuel supply pipe 210B is performed, and the air cleaner upper lid 12 is used for seal. This enables a so-called sub-assembly of the air cleaner 10 and the secondary injectors 204, resulting in excellent maintenability and workability.

Further, the first fuel supply pipe 209 is capable of being separated and connected via the joint clamp 212, and the fuel feedback pipe 211 is inserted from above and connected to the joint 214.

The fuel pump 202 mounted on the fuel tank 201 side can be separated from the components on the air cleaner 10 side by removing the first fuel supply pipe 209 and the fuel feedback pipe 211 from the joint 212 and the joint clamp 214 respectively. This makes it possible to detach and attach only the fuel tank 201 from/to the vehicle frame 101 without removing the air cleaner 10, thereby improving the maintenability and assembly property also in this term.

Further, the first fuel supply pipe 209 is extended from the discharge port of the fuel pump 202 once in the left side direction and arranged upward, then passes on the upper surface at the rear of the air cleaner 10 to be arranged from the left to the right, and then passes on the side surface at the rear part of the air cleaner 10 to be connected to the primary delivery pipe 208.

The pipe arrangement can be made on substantially one plane at the rear surface of the air cleaner 10, thereby making it possible to adjacently arrange the air cleaner 10 with the fuel tank 201 to contribute to securement of capacities of both of them.

Furthermore, the first fuel supply pipe 209 and the joint clamp 212 are housed and arranged in the recessed portion 12*a* of the air cleaner upper lid 12 and arranged below the straight line Z.

The pipe is arranged not to project above both the air cleaner 10 and the fuel tank 201, whereby the upper surface shape of the tank cover 118 covering their upper surfaces is flat without projecting above. This makes it possible to suppress the riding position to be low to enable upper body movement at riding, resulting in improved travel performance.

The present invention has been described together with various embodiments hereinabove, but the present invention is not limited only to the embodiments but may be modified within the scope of the present invention.

The right-and-left relation of the one end side and the other end side of the primary delivery pipe 208 and the secondary delivery pipe 206 may be reverse to that in the above embodiment.

In the above embodiment, the engine unit 116 is similarly applicable to a multicylinder engine other than the four cylinders, namely, for example, parallel six cylinders. In this case, six throttle bodies 123 and so on can be divided into three blocks such as a set of #1 and #2, a set of #3 and $4, and a set of #5 and #6.

According to the present invention, a structure is formed in which an arrangement pitch between secondary injectors is narrowed to narrow a vehicle frame width, by obliquely inclining the secondary injectors and air funnels arranged above throttle bodies though a pitch between cylinders and an arrangement pitch between the throttle bodies is the same. Further, efficient fuel pipe arrangement can be made to make the vehicle body compact and improve the assembly property and the maintenability.

It should be noted that the above embodiments merely illustrate concrete examples of implementing the present invention, and the technical scope of the present invention is not to be construed in a restrictive manner by these embodiments. That is, the present invention may be implemented in various forms without departing from the technical spirit or main features thereof.

What is claimed is:

1. A fuel supply apparatus of a parallel multicylinder engine in which a throttle body is arranged in a vertical posture in an intake passage that links an air cleaner arranged above the parallel multicylinder engine to an engine combustion chamber, the fuel supply apparatus comprising:

air funnels which are provided in the intake passage;

primary injectors that inject fuel, and each one of which is provided for each cylinder; and secondary injectors that inject fuel, and each one of which is provided for each of the cylinders and arranged in the air cleaner and above each one of the air funnels, wherein the secondary injector and the air funnel facing the secondary injector positioned at an outer side in a vehicle width direction are arranged to be inclined such that a base portion of the secondary injector on the outer side in the vehicle width direction is biased to a center side in the vehicle width direction and an injection port thereof is directed to the throttle body.

2. The fuel supply apparatus of the parallel multicylinder engine according to claim 1, wherein an air cleaner body has side surfaces formed to be narrow on an upper surface side in a manner to follow the inclination of the secondary injector and the air funnel, and has an upper surface having an opening portion that is closed by an air cleaner upper lid mounted thereon via a seal member, and wherein a vehicle frame extending from a steering head pipe to a rear of a vehicle having the vehicle frame is arranged on both the side surfaces of the air cleaner body and form substantially uniform gaps along the side surfaces of the air cleaner body.

3. The fuel supply apparatus of the parallel multicylinder engine according to claim 1, further comprising:

a secondary delivery pipe and a pipe support post, the secondary injector being supported by and fixed to the pipe support post fastened to an air cleaner bottom plate via the secondary delivery pipe.

4. The fuel supply apparatus of the parallel multicylinder engine according to claim 3, further comprising:

a fuel tank and a fuel pump, the fuel tank with the fuel pump mounted on a lower surface thereof being adjacently arranged on a vehicle rear side of the air cleaner;

a first fuel supply pipe that connects with the fuel pump; a primary delivery pipe that supplies fuel to the primary injector, the first fuel supply pipe being connected to one end side of the primary delivery pipe;

a second fuel supply pipe that connects with another end side of the primary delivery pipe and is connected to one end side of the secondary delivery pipe; and a fuel feedback pipe that connects with another end side of the secondary delivery pipe and is connected to the fuel pump.

5. The fuel supply apparatus of the parallel multicylinder engine according to claim 4, further comprising:

a joint, the second fuel supply pipe being inserted into an inside of the air cleaner from an outside via the joint and arranged inside the air cleaner.

6. The fuel supply apparatus of the parallel multicylinder engine according to claim 4, further comprising:

a joint of the secondary delivery pipe that is arranged in a manner to project from a communication hole in an upper surface of the air cleaner, corresponding to another end side of the secondary delivery pipe, and the fuel feedback pipe being inserted from above and connected to the joint.

7. The fuel supply apparatus of the parallel multicylinder engine according to claim 4, further comprising:

a joint, the first fuel supply pipe being divided into two halves via the joint at an appropriate middle point in a manner to be capable of being separated from and connected to each other.

8. The fuel supply apparatus of the parallel multicylinder engine according to claim 4, wherein the first fuel supply pipe extended from a discharge port of the fuel pump to a left side in a rear view of the air cleaner passes on an inner side in the vehicle width direction of the fuel feedback pipe and is arranged upward, passes on an upper surface at a rear part of the air cleaner to be arranged from the left to the right, and then passes on a side surface at the rear part of the air cleaner to be connected to the primary delivery pipe located at a lower part.

9. The fuel supply apparatus of the parallel multicylinder engine according to claim 7, wherein the first fuel supply pipe and the joint thereof arranged on an upper surface of the rear part of the air cleaner are arranged below a straight line in contact with an upper surface of the air cleaner and an upper surface of the fuel tank in a side view, and wherein a recessed portion that houses the first fuel supply pipe and the joint thereof is provided in the upper surface of the rear part of the air cleaner.

* * * * *